US012234730B2

(12) United States Patent
Jin et al.

(10) Patent No.: US 12,234,730 B2
(45) Date of Patent: Feb. 25, 2025

(54) UNDERWATER ROBOT FOR MINE FLOODING RESCUE

(71) Applicant: Anhui University of Science and Technology, Huainan (CN)

(72) Inventors: Huawei Jin, Huainan (CN); Haitao Ji, Huainan (CN); Fangzheng Yan, Huainan (CN)

(73) Assignee: Anhui University of Science and Technology, Huainan (CN)

( * ) Notice: Subject to any disclaimer, the term of this patent is extended or adjusted under 35 U.S.C. 154(b) by 0 days.

(21) Appl. No.: 18/432,330

(22) Filed: Feb. 5, 2024

(65) Prior Publication Data

US 2024/0175361 A1 May 30, 2024

Related U.S. Application Data

(63) Continuation of application No. PCT/CN2022/087380, filed on Apr. 18, 2022.

(30) Foreign Application Priority Data

Mar. 29, 2022 (CN) ..... 202210322985.4

(51) Int. Cl.

| | |
|---|---|
| ***E21F 11/00*** | (2006.01) |
| *B63C 9/00* | (2006.01) |
| *B63G 8/00* | (2006.01) |

(52) U.S. Cl.

CPC ..... *E21F 11/00* (2013.01); *B63C 9/00* (2013.01); *B63G 2008/004* (2013.01)

(58) Field of Classification Search

CPC ..... E21F 11/00; B63G 2008/002; B63G 2008/004; B63G 2008/005; B63G 8/40; B63C 9/00; B25J 15/0028; B25J 15/0213; B25J 15/022

See application file for complete search history.

(56) References Cited

FOREIGN PATENT DOCUMENTS

| | | | | | |
|---|---|---|---|---|---|
| CN | 101975079 | A | | 2/2011 | |
| CN | 201924961 | U | | 8/2011 | |
| CN | 102606203 | A | * | 7/2012 | |
| CN | 102616354 | A | * | 8/2012 | |
| CN | 103010429 | A | | 4/2013 | |
| CN | 206351443 | U | | 7/2017 | |
| CN | 206455650 | U | | 9/2017 | |
| CN | 108860508 | A | * | 11/2018 | |
| CN | 108891559 | A | | 11/2018 | |
| CN | 110017165 | A | * | 7/2019 | ..... B25J 11/00 |

(Continued)

OTHER PUBLICATIONS

First Office Action issued in counterpart Chinese Patent Application No. 202210322985.4, dated Jul. 20, 2022.

(Continued)

*Primary Examiner* — Nicole Coy
*Assistant Examiner* — Michael A Goodwin
(74) *Attorney, Agent, or Firm* — Westbridge IP LLC

(57) ABSTRACT

Disclosed is an underwater robot for a mine flooding rescue, including a starting unit configured to control the implementation of a whole rescue action; a drive unit connected with the starting unit and configured to provide a robot with power to move; and an execution unit connected with the drive unit and configured to salvage underwater life sources.

5 Claims, 13 Drawing Sheets

(56) References Cited

FOREIGN PATENT DOCUMENTS

| | | | | | |
|---|---|---|---|---|---|
| CN | 211364866 | U | | 8/2020 | |
| CN | 112847293 | A | * | 5/2021 | ..... B25J 15/0213 |
| CN | 214084700 | U | | 8/2021 | |
| CN | 113581421 | A | | 11/2021 | |
| CN | 113669102 | A | | 11/2021 | |
| JP | 2011098403 | A | | 5/2011 | |
| WO | 2012115569 | A1 | | 8/2012 | |

OTHER PUBLICATIONS

Grant Notification issued in counterpart Chinese Patent Application No. 202210322985.4, dated Oct. 9, 2022.

* cited by examiner

UNDERWATER ROBOT FOR MINE FLOODING RESCUE

CROSS-REFERENCE TO RELATED APPLICATIONS

This application is a continuation of International Application No. PCT/CN2022/087380, filed on Apr. 18, 2022, which claims priority to Chinese Patent Application No. 202210322985.4, filed on Mar. 29, 2022. The disclosures of the above-mentioned applications are hereby incorporated by reference in their entireties.

TECHNICAL FIELD

The present disclosure relates to the technical field of robots, and in particular to an underwater robot for a mine flooding rescue.

BACKGROUND

As numerous underground personnel flow and work in different tunnels and an electric locomotive and other transportation devices move and displace consecutively on a large scale during coal mine production, incapability of monitoring the real-time position of this kind of dynamic target in time will certainly bring inconvenience to high-efficiency and orderly production scheduling, thus reducing the production efficiency. However, once a flooding accident occurs, quickly and effectively organizing to rescue will be certainly affected since the specific positions of the trapped underground personnel and the number of people at each place cannot be determined in time, leading to the increase of a threat to the life safety of the workers in danger. Underground flooding refers to a mine disaster accident formed since a wall is cut through to communicate with large water sources (such as an underwater river, a reservoir and an old mine filled with water) when mining an underground deposit. In recent years, China has paid high attention to the safety of the coal mine production and the coal mine waterproofing work has also achieved some effects, and however the flooding accident still occurs occasionally due to the influence of various reasons. According to incomplete statistics, about 285 flooding accidents occurred in various major coal mines in China, causing 1,728 deaths and an economic loss of hundreds of millions Yuan during ten years from 2005 to 2014. Thus, the harm of the coal mine underground flooding accident is very huge. Hence, to effectively prevent the occurrence of the flooding accident, the reason thereof must be analyzed. In general, the reason of the flooding accident may be summarized into two aspects: on the one hand, the flooding accident is caused by management factors, and on the other hand, the flooding accident is caused by technical factors: after the flooding accident occurs, rescue personnel are hard to quickly and effectively rescue trapped life sources in time due to the limitation of a complex accident environment, thus leading to the safety accident caused by the delayed rescue.

SUMMARY

The main purpose of the present disclosure is to provide an underwater robot for a mine flooding rescue, aiming at solving the existing technical issue that a rescue work is hard to be carried out quickly and effectively due to a complex accident environment.

In order to achieve the foregoing purpose, the present disclosure provides an underwater robot for a mine flooding rescue, including:

- a starting unit configured to control the implementation of a whole rescue action;
- a drive unit connected with the starting unit and configured to provide a robot with power to move; and
- an execution unit connected with the drive unit and configured to salvage underwater life sources.

Further, the starting unit includes two end covers with surfaces having uniform ridged protrusions, end disks connected with the end covers, and a housing in a rectangular structure; and the housing is arranged between the two end disks.

Further, the starting unit further includes microcontroller units arranged inside the end covers, microcontroller unit chips, and switch buttons arranged on surfaces of the end covers.

Further, the starting unit further includes cameras and mounting bolts for mounting the cameras, and the cameras are arranged around a surface of the housing, to collect pictures around the robot.

Further, the drive unit includes connecting rods, direction-connecting rods arranged at both ends of the connecting rods, and propellers connected with the direction-connecting rods; and two connecting rods are provided on both sides of the end disks, and fixedly connected with the end disks.

Further, the execution unit includes a guide rod, a hexagonal end cover connected with one end of the guide rod, a coupling connected with the end covers, a connecting bolt connected with the coupling, a moving piston sleeved on the guide rod and a manipulator mechanism connected with the other end of the guide rod.

Further, the manipulator mechanism includes two contact clips, links connected with the contact clips, a single gear and double gears which are separately connected with the two contact clips, an end plate connected with the links, a spur gear arranged on the end plate and a torque motor for driving, and the single gear is in meshing connection with the double gears.

Further, the underwater robot for the mine flooding rescue further includes a hydrodynamic motor arranged on the guide rod, and the hydrodynamic motor includes an outer shell, a rotating shaft and a rotating inner core which are arranged in the outer shell, a power ring and a starting switch which are arranged on the outer shell, and threaded holes formed in an end part of the outer shell.

Further, the underwater robot for the mine flooding rescue further includes a life rescue box mounted on the end covers and arranged together with the execution unit on a same side, to carry life sources rescued by the execution unit.

Further, the life rescue box includes a recovery box, a floating ladder connected with a lower end of the recovery box, a connecting beam connected with the lower end of the recovery box, and two suspended wheels arranged at a bottom of the recovery box.

The beneficial effects of the present disclosure are reflected as follows.

In the present disclosure, the microcontroller units control the propellers of the underwater robots to achieve braking, when the propellers are started, the robot can go up, down, forwards and backwards in multiple degrees of freedom, when the torque motor reverses, the coupling promotes the manipulator mechanism to act, when the underground flooding accident occurs, the underground position of a person can be determined through visual identification of the manipulator mechanism, so a flexible change can be made when encountering an emergency in case of flooding, such that the robot is convenient to process a series of problems, such as dragging the underwater life sources and some sundries onto the ground.

DETAILED DESCRIPTION OF THE EMBODIMENTS

Figure 1:
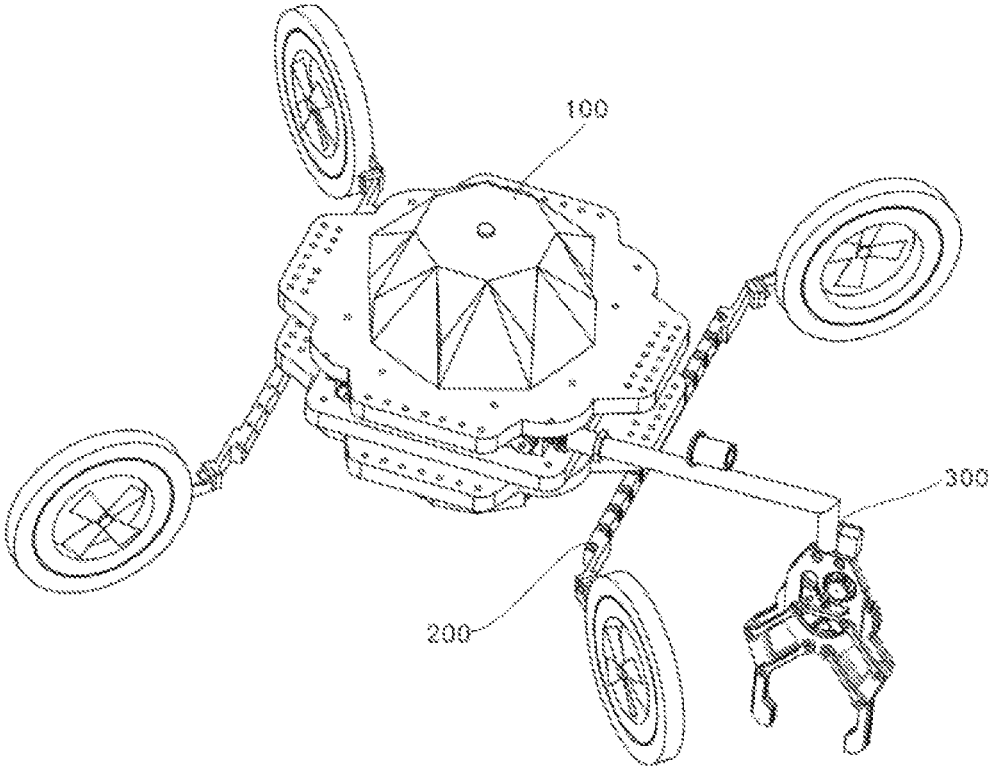
FIG. 1 is a structure schematic diagram of the present disclosure.

The following clearly and completely describes the technical solutions in the embodiments of the present disclosure in conjunction with the accompanying drawings in the embodiments of the present disclosure. Apparently, the described embodiments are some rather than all of the embodiments of the present disclosure. The embodiments in the present disclosure and features in the embodiments may be combined with each other without conflict. Based on the embodiments of the present disclosure, all the other embodiments obtained by those of ordinary skill in the art on the premise of not contributing creative effort should belong to the protection scope of the present disclosure.

It is to be noted that if directional indication, such as: upper, lower, left, right, front, rear, etc. is involved in the embodiments of the present disclosure, the directional indication is merely used to explain the relative position relation, movement and the like of various components under a certain special posture (as shown in the drawings); and if the special posture is changed, the directional indication will change accordingly.

In addition, if the descriptions "first" and "second" are involved in the embodiments of the present disclosure, the descriptions "first" and "second" are merely used for description, instead of being understood as indicating or implying relative importance or impliedly indicating the quantity of the showed technical features. Thus, the features defined with "first" and "second" may expressly or impliedly one or more features. In addition, the meaning of "and/or" in the text includes three parallel schemes, take "A and/or B" for example, including A scheme, or B scheme, or the scheme meeting A and B at the same time. In addition, "a plurality of" means two or above two. Thus, the technical solutions of various embodiments may be mutually combined, but must be achieved by those of ordinary skill in the art. When the combination of the technical solution has mutual contradiction or cannot be achieved, it should believe that such combination of the technical solution does not exist.

Please refer to FIG. 1, an underwater robot for a mine flooding rescue provided by the present disclosure includes:

- a starting unit 100 configured to control the implementation of a whole rescue action; and in wireless control through an external control device;
- a drive unit 200 connected with the starting unit 100 and configured to provide a robot with power to move; and
- an execution unit 300 connected with the drive unit 200 and configured to salvage underwater life sources.

When a mine disaster accident occurs, the narrow space in the mine channel and accompanying of a certain flooding situation will bring great difficulties to the rescue work, and usually the best rescue opportunity will be missed. However, most traditional rescues can only detect the presence of life sources and not help the life sources get out when detecting the life sources, and the life sources may be quickly and effectively detected and rescued by the underwater robot provided by the present disclosure.

During working, the robot is placed in the mine channel, the drive unit 200 is controlled to drive the execution unit 300 to move along a direction of the mine channel, the execution unit 300 is used for achieving a salvage operation for the life sources, and the starting unit 100 is configured to control coordination actions of the drive unit 200 and the execution unit 300, to avoid the occurrence of a slipping issue when grabbing the life sources.

Figure 2:
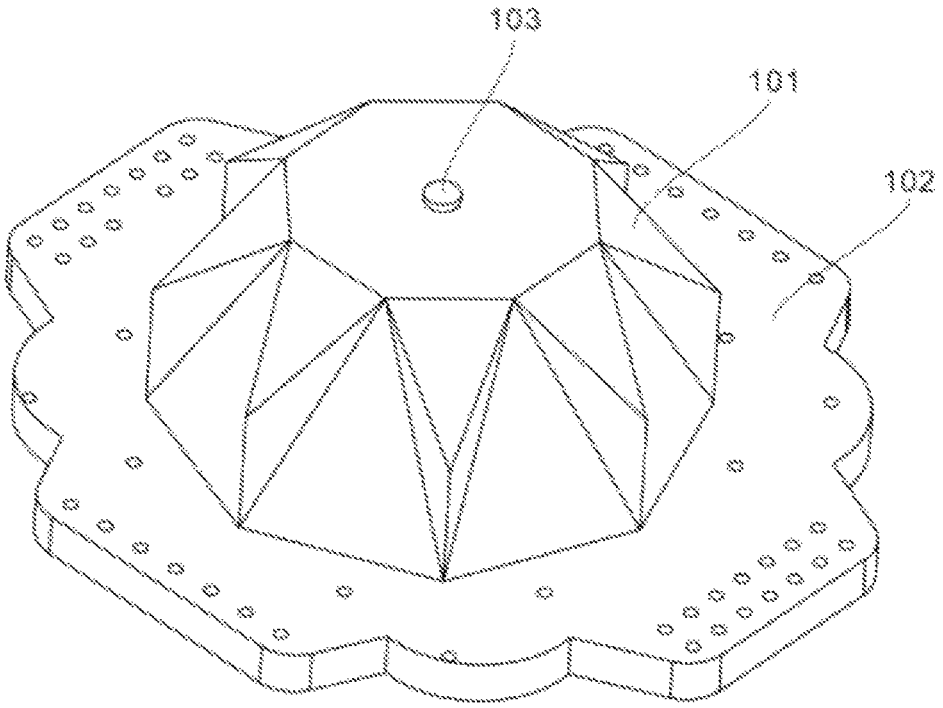
FIG. 2 is a structure schematic diagram of an end cover in the present disclosure.

In one embodiment, please refer to FIG. 2, the starting unit 100 includes two end covers 101 with surfaces having uniform ridged protrusions, end disks 102 connected with the end covers 101, and a housing 104 in a rectangular structure; and the housing 104 is arranged between the two end disks 102. The end covers are arranged on the housing 104, and the end covers are fixed together with the housing 104 through screws; and specifically a plurality of M3 and M5 holes are formed in the end disks 102, and the end covers on the housing 104 penetrate through the M3 and M5 holes through double-end bolts and are fixedly connected with the end disks 102.

Figure 3:
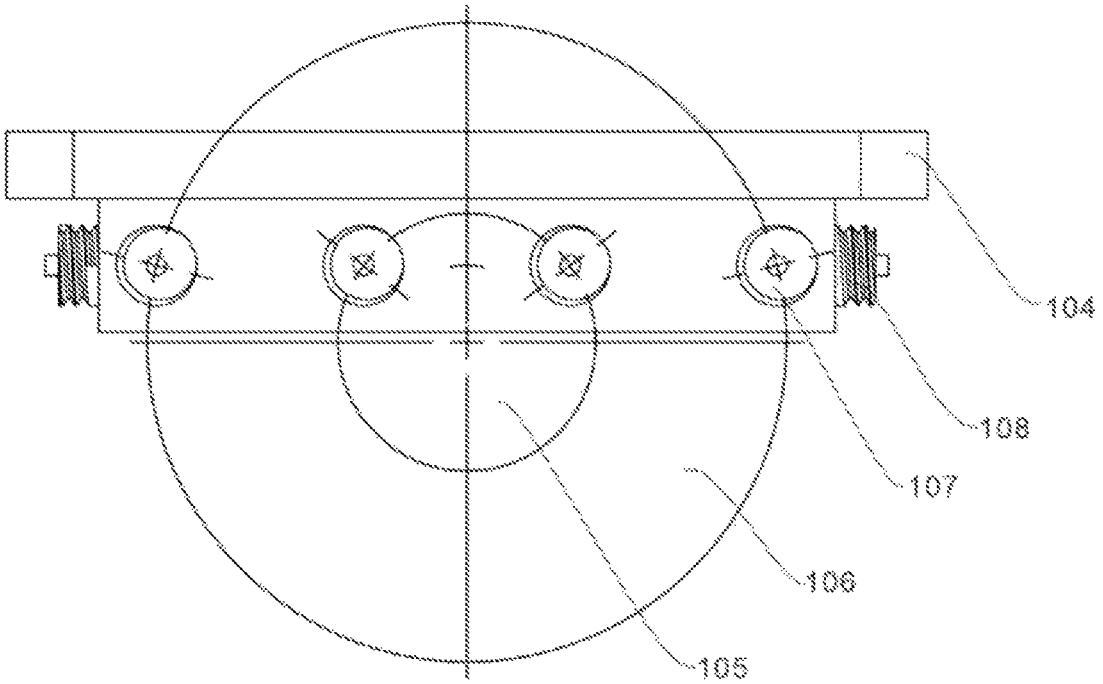
FIG. 3 is a front schematic diagram of a housing structure in the present disclosure.

In one embodiment, please refer to FIG. 3, the starting unit 100 further includes microcontroller units 106 arranged inside the end covers 101, microcontroller unit chips 105, and switch buttons 103 arranged on surfaces of the end covers 101.

The microcontroller units 106 preferably adopts the SM32—microcontroller units, when the switch buttons 103 are pressed, the whole robot is started, such that the underwater robot is controlled to implement braking in underground flooding, and the robot can go up, down, forwards and backwards in multiple degrees of freedom.

Kernels of the SM32—microcontroller units: Advanced RISC Machine 32-bit, Cortex series, Cortex M3CPU (ARM®32-bit Cortex®-M3CPU), with a maximum working frequency of 72 MHZ, 1. 25DMIPS/MHz, a single-cycle multiplication and a hardware division: SM32-microcontroller unit memory: Flash memory of on-chip integration 32-512 KB. 6-64 KB SRAM (Static Random Access Memory): SM32-microcontroller unit clock, reset and power management: 2.0-3.6V power supply and a drive voltage of an I/O interface. POR (Power On Reset), PDR (Power Down Reset) and PVD (Programmable Voltage Detector). 4-16 MHZ crystal oscillator. Build-in of 8MHzRC oscillating circuit adjusted before leaving a factory. An internal 40 KHz RC oscillating circuit, PLL (Phase Locked Loop) for a CPU (Central Processing Unit) clock and a 32 kHz crystal oscillator with calibration for RTC (Real Time Clock).

SM32-microcontroller unit debugging mode: SWD (Serial Wire Debug) and JTAG (Joint Test Action Group) interface. Up to 112 quick I/O ports, 11 timers and 13 communication interfaces.

The starting of the SM32-microcontroller units drives the whole robot to float and dive, the robot will encounter a great obstacle in a special case of the underground flooding, and therefore the microcontroller unit chips 105 may adjust the forward speed and the carrying power for propelling the whole robot.

The SM32-microcontroller units send an instruction to regulate a rotating speed and a torque to achieve the control for the braking force of a braking device and the formulation of the response time of the execution unit 300;

The advantage of the control by the SM32-microcontroller units is that the real-time control for the braking force of the execution structure in the execution unit and the response time thereof may be achieved by using a feedback signal of the execution unit, where the execution structure is appropriate for the rigor of the underwater rescue robot and convenient to mount and disassemble, to avoid a series of issues such as leakage caused by hydraulic drive.

Figure 4:
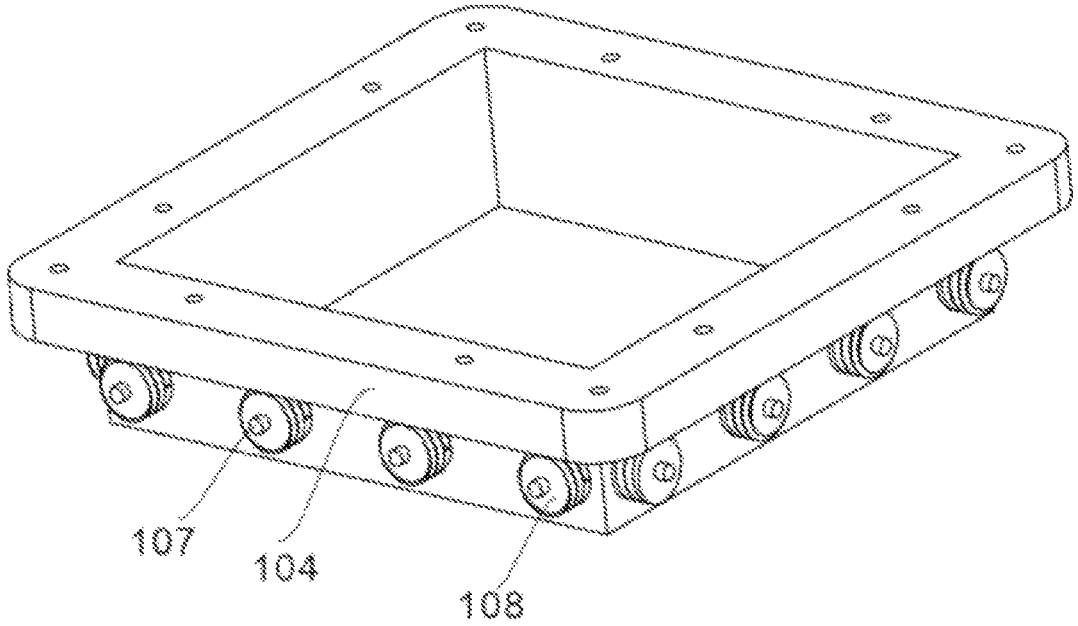
FIG. 4 is a schematic diagram of a housing structure in the present disclosure.

In one embodiment, please refer to FIG. 4, the starting unit 100 further includes cameras 107 and mounting bolts 108 for mounting the cameras 107, and the cameras 107 are arranged around a surface of the housing 104, to collect pictures around the robot. The cameras 107 include the cameras with functions of lighting and picture collection.

The foremost end of the robot is separately a main camera and an auxiliary camera which capture and collect unknown objects, the lighting camera is used for lighting lines, the leftmost end is separately a left-front camera, a left-middle camera and a left-rear camera which can achieve the detection for unknown objects on a left side, the rightmost end is separately a right-front camera, a right-middle camera and a right-rear camera which can achieve the detection for unknown objects on a right side, such that the rescue personnel can clearly know the situation of the unknown objects around the robot, to help the rescue personnel quickly know about the situation in time for the rescue operation.

Figure 6:
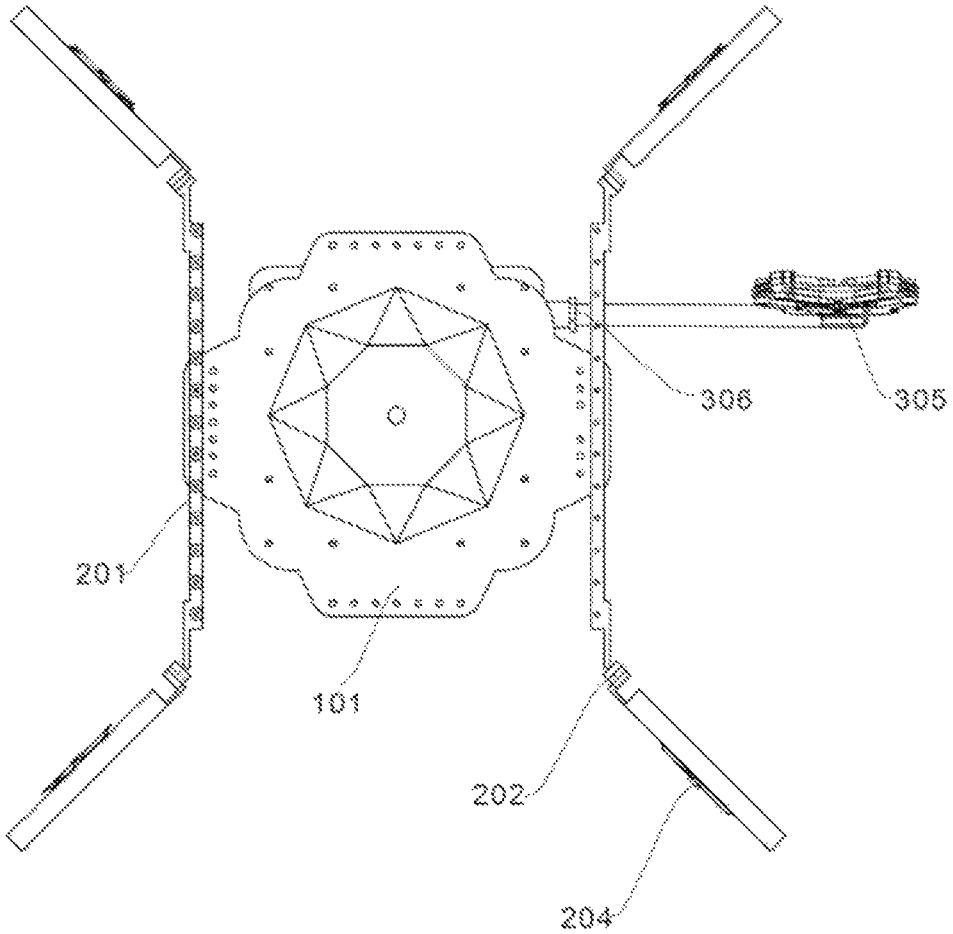
FIG. 6 is a schematic top view of a robot structure in the present disclosure.

In one embodiment, please refer to FIG. 6, the drive unit 200 includes connecting rods 201, direction-connecting rods 202 arranged at both ends of the connecting rods 201, and propellers 203 connected with the direction-connecting rods 202; and two connecting rods 201 are provided on both sides of the end disks 102, and fixedly connected with the end disks 102.

A total of four propellers 203 are arranged to provide the robot with a stable moving force, and the connecting rods 201 are uniformly provided with connecting holes and fixedly connected with the end disks 102 through bolts.

The propellers 203 consist of impellers and axle holes, wind wheels are connected with axle sleeves that are connected with the direction-connecting rods 202, when SM32-microcontroller units are started, the impellers accelerate to rotate, the robot starts to rise and makes a directional cruise along a patrol line, and a process that the robot approaches a target object is quickened by the existing process.

Figure 5:
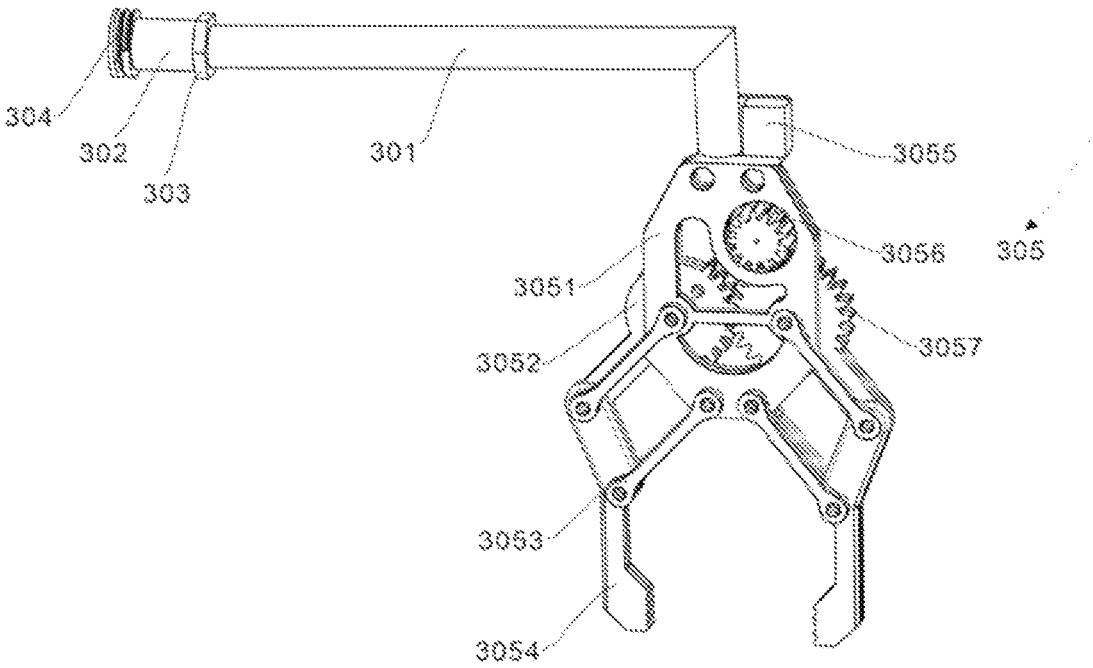
FIG. 5 is a structure schematic diagram of an execution unit in the present disclosure.

In one embodiment, please refer to FIG. 5, the execution unit 300 includes a guide rod 301, a hexagonal end cover 303 connected with one end of the guide rod 301, a coupling 302 connected with the end covers 101, a connecting bolt 304 connected with the coupling 302, a moving piston 306 sleeved on the guide rod 301 and a manipulator mechanism 305 connected with the other end of the guide rod 301, where the whole structure of the guide rod 301 is fixed to the end disks 102 through the connecting bolt 304.

An included angle between the guide rod 301 and the manipulator mechanism 305 should be 90 degrees to achieve the vertical reversing of motions, a length of the guide rod 301 and a size of the manipulator mechanism 305 may be set based on actual demands, to change the freedom transformation of the motions of the manipulator mechanism 305, thereby implementing the coordination in a special case.

Figure 7:
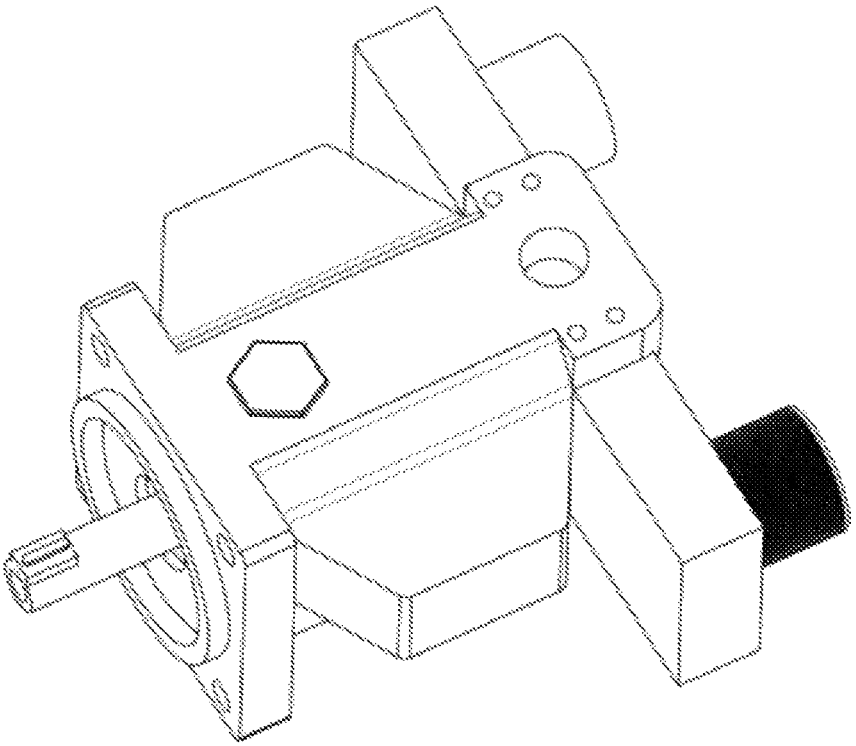
FIG. 7 is a schematic diagram of a solid structure of a moving piston in the present disclosure.

Please refer to FIG. 7, the moving piston 306 is controlled through electric power and provided with an output shaft, the output shaft is connected with the guide rod 301, the guide rod 301 is driven to move through the scalable output shaft to increase the power of the guide rod 301 and assist the guide rod 301 for expansion, thereby increasing the power to the manipulator mechanism 305 and improving the power to drag the life sources.

The guide rod 301 is an electric scalable structure, an electric scalable rod, a linear driver and other structures may be adopted, to drag the life sources clamped by the manipulator mechanism 305 to the direction of the robot.

In one embodiment, please refer to FIG. 5, the manipulator mechanism 305 includes two contact clips 3054, links 3053 connected with the contact clips 3054, a single gear 3052 and double gears 3057 which are separately connected with the two contact clips 3054, an end plate 3051 connected with the links 3053, a spur gear 3056 arranged on the end plate 3051 and a torque motor 3055 for driving, and the single gear 3052 is in meshing connection with the double gears 3057.

The contact clips 3054 can transform between two freedoms in the same plane to achieve the purpose of stably holding the target object when the underground flooding occurs, unidirectional motions of the contact clips 3054 depend on the interference fit of the single gear 3052 and the double gears 3057, to prevent the contact clips 3054 occurring unidirectional axial motions, the single gear 3052 and the double gears 3057 are placed in the end plate 3051 of the manipulator, and meanwhile the end plate 3051 of the manipulator is provided with the spur gear 3056 to effectively avoid a braking failure caused by an axial motion of the guide rod 301.

An output shaft of the torque motor 3055 is connected with a worm by using the coupling, the speed and torque of the torque motor 3055 are controlled to achieve the control for the braking response time and braking torque of the braking structure together, to achieve actual use demands; and the torque motor 3055 is used for providing the braking force to the manipulator mechanism 305, without needing a complex hydraulic system, avoiding a series of issues such as leakage caused by the hydraulic drive.

Figure 8:
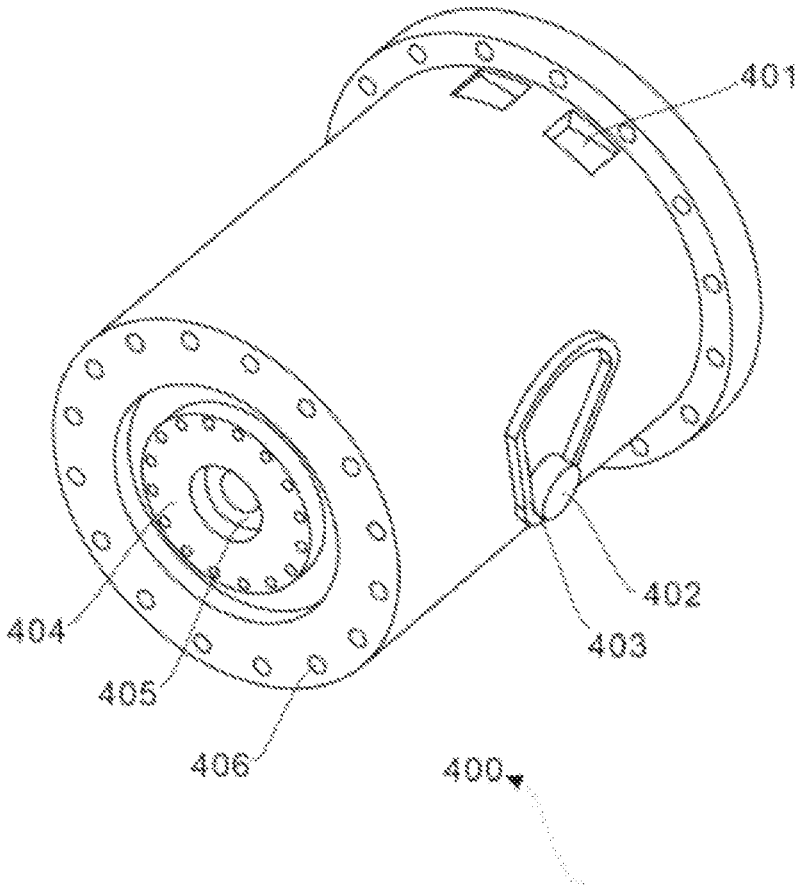
FIG. 8 is a structure schematic diagram of a hydrodynamic motor in the present disclosure.

In one embodiment, please refer to FIG. 8, the underwater robot for the mine flooding rescue further includes a hydrodynamic motor 400 arranged on the guide rod 301, and the hydrodynamic motor 400 includes an outer shell 401, a rotating shaft 404 and a rotating inner core 405 which are arranged in the outer shell 401, a power ring 403 and a starting switch 402 which are arranged on the outer shell 401, and threaded holes 406 formed in an end part of the outer shell 404, where the workers are convenient to hold the hydrodynamic motor by the power ring 403 during disassembly, and the power ring 403 pops out through the starting switch.

The hydrodynamic motor 400 further includes a spring plunger, which can provide a buffer action when the underwater motion of the robot encounters a greater water resistance or the power supply of the torque motor 3055 is insufficient.

When the hydrodynamic motor 400 is working, the electric power drives the rotating shaft 404 to rotate, drives the rotating inner core 405 to rotate and drives water flows to pass through therebetween, to generate a water flow thrust in the same direction as the moving direction of the manipulator mechanism 305, and extra power is provided to the manipulator mechanism 305, to drive the manipulator mechanism 305 to effectively drag the life sources.

Figure 11:
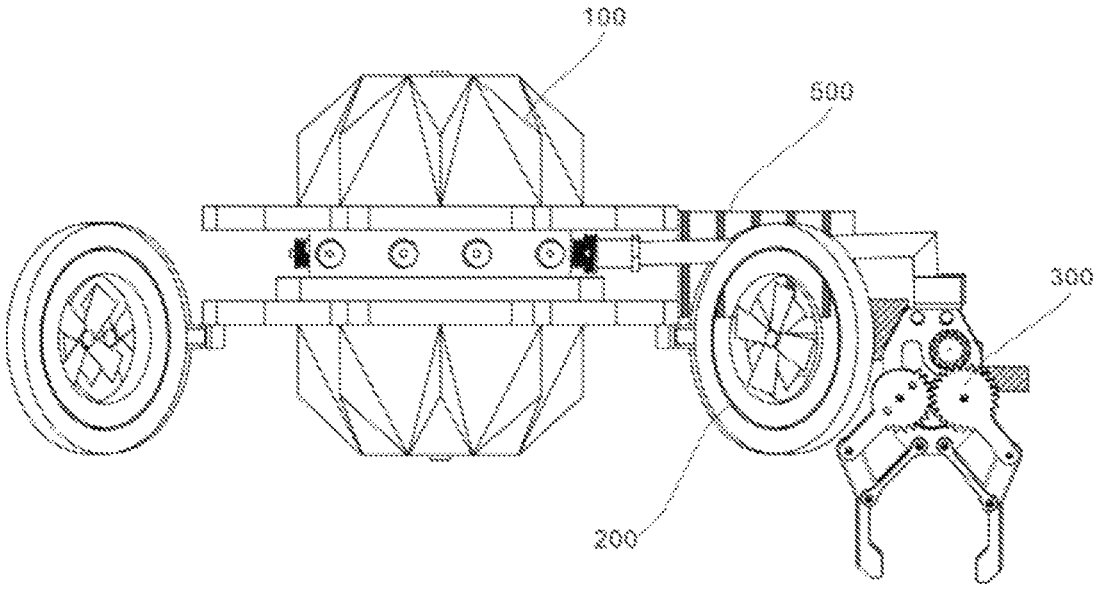
FIG. 11 is a connecting schematic diagram of a life rescue box and a robot in the present disclosure.

In one embodiment, please refer to FIG. 11, the underwater robot for the mine flooding rescue further includes a life rescue box 500 mounted on the end covers 101 and arranged together with the execution unit 300 on a same side, such that the life sources just move onto the life rescue box 500 when the manipulator mechanism 305 drags the life sources to the direction of the starting unit 100 without other excessive reversing actions, to improve the rescue efficiency and carry the life sources rescued by the execution unit 300, dragging the rescued life sources onto the life rescue box 500 through the manipulator mechanism 305 provides a certain carrying capacity to the life sources and reduces the resistance when the robot returns, and the life rescue box 500 has a certain buoyancy and at the same time can provide a stable support force to the life sources.

Figure 9:
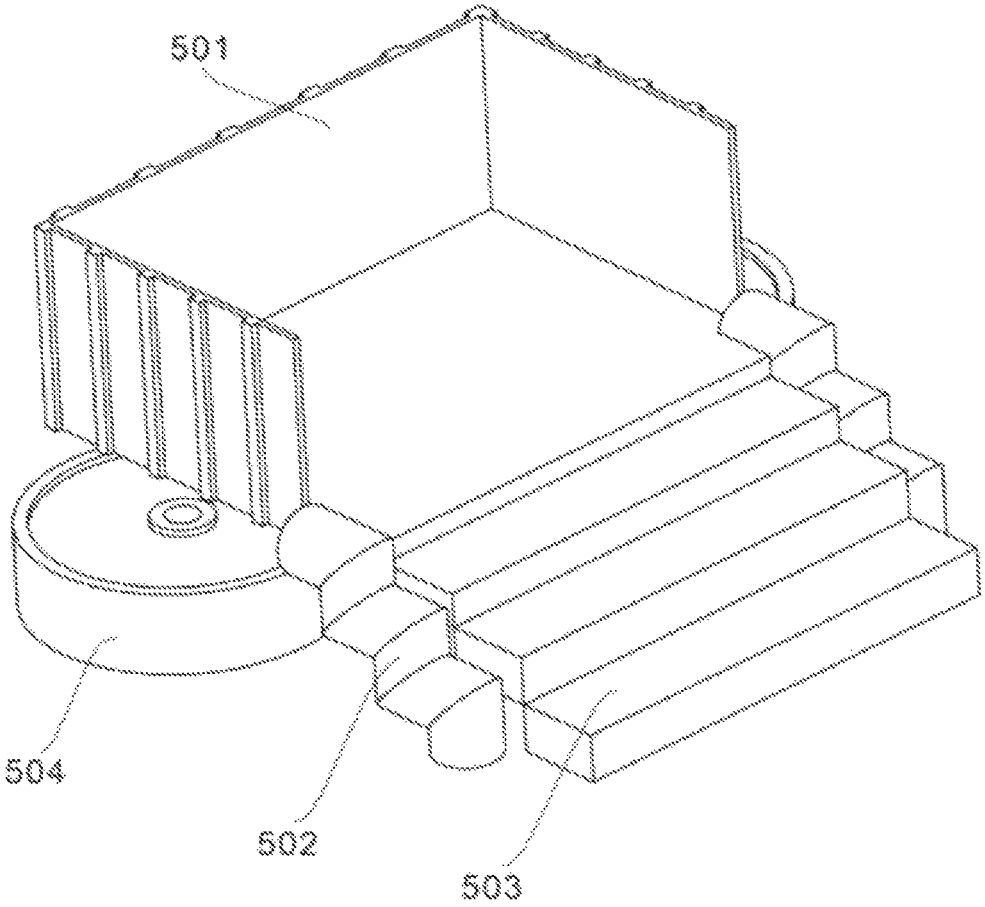
FIG. 9 is a structure schematic diagram of a life rescue box in the present disclosure.
Figure 10:
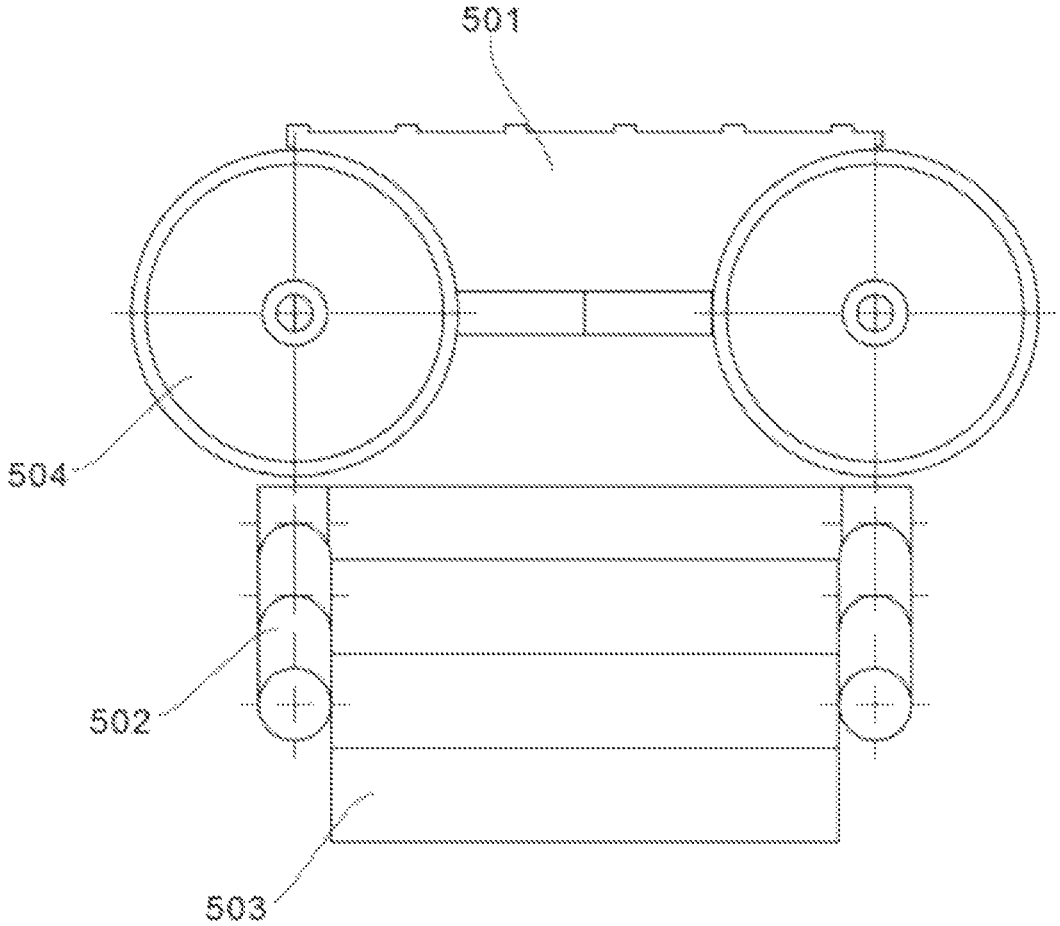
FIG. 10 is a schematic bottom view of a structure of a life rescue box in the present disclosure.

In one embodiment, please refer to FIG. 9 and FIG. 10, the life rescue box 500 includes a recovery box 501, a floating ladder 503 connected with a lower end of the recovery box 501, a connecting beam 502 connected with the lower end of the recovery box 501, and two suspended wheels 504 arranged at a bottom of the recovery box 501; and the setting of the floating ladder 503 is convenient to drag the life sources into the recovery box 501 smoothly, and the setting of the suspended wheels 504 is used to provide a certain buoyancy to the recovery box 501, thus carrying the weight of the life sources themselves and reducing the resistance when the robot returns.

The working principles of this application are described as follows.

Figure 12:
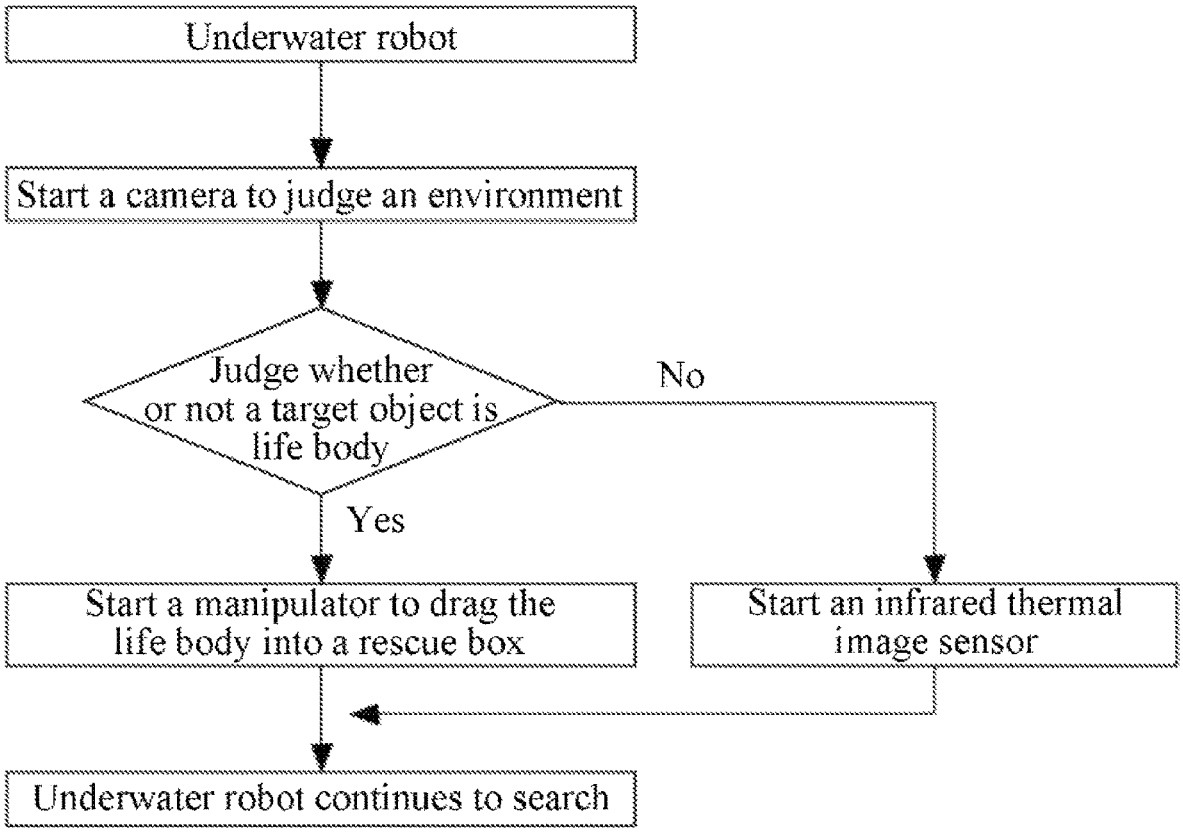
FIG. 12 is a schematic diagram of a rescue program in the present disclosure.
Figure 13:
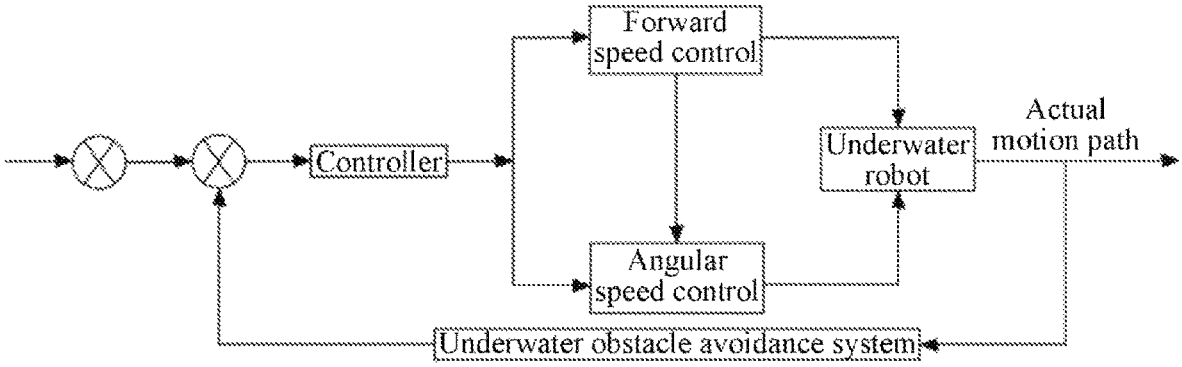
FIG. 13 is a visual program schematic diagram of a robot in the present disclosure.

Please refer to FIG. 12 and FIG. 13, the switch buttons 103 are controlled, the SM32-microcontroller units located at an inner end of the housing 104 are started through connecting wires, the SM32-microcontroller units send out signals to the cameras through the microcontroller unit chips 105, and the cameras 107 appear pictures on OPPENSV along a programmable controller until the whole robot starts cruising.

The drive unit 200 is started, the signal is sent to the propellers 203, the suspended wheels 504 are driven to rotate, such that the underwater rescue robot may move oppositely along the mine channel to search life bodies with life sources, and the whole robot starts to float and dive to prevent the slipping phenomenon, and then completes the braking process.

The drive unit 200 is started, the programmable controller sends out the instruction to the torque motor 3055 to regulate the rotating speed and the torque to achieve the control for the braking device and the formulation of the response time.

The torque motor 3055 brakes the manipulator, the spur gear 3056 in the manipulator rotates and drives the single gear 3052 and the double gears 3057 to rotate, the single gear 3052 is tightly connected with the double gears 3057, and the coupling is pushed to drive the contact clips 3054 for dragging, and on the other hand, the power is provided to the manipulator by pushing, the programmable controller sends a digital signal and an analog signal to the manipulator, such that the manipulator can pull the life bodies with the life sources onto the rescue box.

The hydrodynamic motor 400 can provide the strong power source in a case that the manipulator has an insufficient capacity, when the starting switch 402 is pressed, the power ring 403 will pop out immediately, the rotating shaft 404 accelerates to rotate to drive the rotating inner core 405 to accelerate to rotate, such that the hydrodynamic motor 400 can provide the strong power source to the manipulator structure 305, and the manipulator is driven to drag the life sources onto the life rescue box 500.

Experiment result analysis on experiment testing of the device in the present disclosure is further given below.

Please refer to FIG. 12 and FIG. 13, the magnitude of the braking power of the manipulator is the most direct reflection for the braking effect of the contact clips 3054 of the braking structure, and a detail narration is made to obtain a relationship of a braking tread among the recovery box 501, the current and the travel, with the steps as follows.

1) According to demands of mine complexity, the torque motor 3055 and the switch buttons 103 are mounted and fixed.

2) The drive unit SM32-microcontroller units in the switch buttons 103 are mounted and fixed, to ensure that the drive unit SM32-microcontroller units start four of 12 cameras 107 located on the upper end cover of the housing 104 after the switch buttons 103 are pressed, such that the robot has a touring scope with a bright and wide view.

3) The manipulator mechanism 305 of the execution unit 300 is in seamless connection with the guide rod 301, the single gear 3052 and the double gears 3057 in the manipulator are interconnected as the torque motor 3055 is started, pinions of the gear are connected and mesh along mutual seams, to speed up the rotation, and thus driving the spur gear 3056 to push the two contact clips 3054.

4) The two contact clips 3054 increase the power to clamp the target object under the influence of the great current of the torque motor 3055.

5) The power is on, the program is input into the programmable controller, the instruction sent by the programmable controller controls the rotation of the torque motor 3055 and the SM32-microcontroller units: the digital signal sent by the programmable controller changes the steering of the torque motor 3055, the analog signal changes the output drive force and the drive speed of the torque motor 3055, and a pulse signal sent by the programmable controller controls the torque motor 3055 to drive the manipulator for target object searching.

The manipulator finds the underground flooding target object under the lighting of the cameras 107 and drags the target object onto the floating ladder 503 of the recovery end cover, the floating ladder 503 specially increases the torque to pull the target object onto the recovery box 501 in a special case of underground flooding, the recovery box 501 has a certain frictional force to ensure that the target object will not fall, and the switch buttons 103 are started again to seal the recovery box 501, thus being taken out of the mine.

The above are only optional embodiments of the present disclosure and not intended to limit the present disclosure. Any modifications, equivalent replacements, improvements and the like made within the spirit and principle of the present disclosure shall fall within the protection scope of the present disclosure.

What is claimed is:

1. An underwater robot for a mine flooding rescue, comprising:

a starting unit configured to control implementation of a whole rescue action;

a drive unit connected with the starting unit and configured to provide the underwater robot with power to move; wherein the starting unit comprises two end covers with surfaces having uniform ridged protrusions, end disks connected with the end covers, and a housing that is a rectangular-shaped structure; and the housing is arranged between the two end disks, wherein the starting unit further comprises microcontroller units arranged inside the end covers and microcontroller unit chips;

an execution unit connected with the drive unit and configured to salvage underwater life sources; wherein the execution unit comprises a guide rod, a hexagonal end cover connected with one end of the guide rod, a coupling connected with the end covers, a connecting bolt connected with the coupling, a moving piston sleeved on the guide rod and a manipulator mechanism connected with the other end of the guide rod; the manipulator mechanism comprises two contact clips, links connected with the contact clips, a single gear and double gears which are separately connected with the two contact clips, an end plate connected with the links, a spur gear arranged on the end plate and a torque motor for driving, and the single gear is in meshing connection with the double gears; and a life rescue box mounted on the end covers and arranged together with the execution unit on a same side of the underwater robot, to carry life sources rescued by the execution unit; wherein the life rescue box comprises a recovery box, a floating ladder connected with a lower end of the recovery box, a connecting beam connected with the lower end of the recovery box, and two suspended wheels arranged at a bottom of the recovery box.

2. The underwater robot for the mine flooding rescue according to claim 1, wherein the starting unit further comprises switch buttons arranged on surfaces of the end covers.

3. The underwater robot for the mine flooding rescue according to claim 1, wherein the starting unit further comprises cameras and mounting bolts for mounting the cameras, and the cameras are arranged around a surface of the housing, to collect pictures around the underwater robot.

4. The underwater robot for the mine flooding rescue according to claim 3, wherein the drive unit comprises connecting rods, direction-connecting rods arranged at both ends of the connecting rods, and propellers connected with the direction-connecting rods; and two connecting rods are provided on both sides of the end disks, and fixedly connected with the end disks.

5. The underwater robot for the mine flooding rescue according to claim 4, further comprising a hydrodynamic motor arranged on the guide rod, wherein the hydrodynamic motor comprises an outer shell, a rotating shaft and a rotating inner core which are arranged in the outer shell, a power ring and a starting switch which are arranged on the outer shell, and threaded holes formed in an end part of the outer shell.

* * * * *